US007997414B2

(12) United States Patent
Niitti

(10) Patent No.: US 7,997,414 B2
(45) Date of Patent: Aug. 16, 2011

(54) METHOD FOR SEPARATING PARTICLES IN HYDROUS SLURRY AND A HINDERED-BED SEPARATOR

(75) Inventor: Timo Niitti, Kuopio (FI)

(73) Assignee: Outotec Oyj, Espoo (FI)

( * ) Notice: Subject to any disclaimer, the term of this patent is extended or adjusted under 35 U.S.C. 154(b) by 50 days.

(21) Appl. No.: 12/341,053

(22) Filed: Dec. 22, 2008

(65) Prior Publication Data

US 2010/0155309 A1 Jun. 24, 2010

(51) Int. Cl.
*B03B 5/66* (2006.01)

(52) U.S. Cl. ..... 209/154; 209/159; 209/501

(58) Field of Classification Search ..... 209/154, 209/158, 159, 500, 501
See application file for complete search history.

(56) References Cited

U.S. PATENT DOCUMENTS 3,308,951 A * 3/1967 Evans ..... 209/158
4,301,001 A * 11/1981 Lofthouse ..... 209/17
4,394,258 A * 7/1983 Zipperian ..... 209/170
4,496,464 A * 1/1985 Hensley ..... 210/792
4,533,464 A * 8/1985 Smith et al. ..... 209/158
4,807,761 A * 2/1989 Hollingsworth ..... 209/158
6,264,040 B1 * 7/2001 Mankosa et al. ..... 209/158
6,425,485 B1 * 7/2002 Mankosa et al. ..... 209/164
6,953,123 B2 * 10/2005 Niitti ..... 210/388
7,147,111 B2 * 12/2006 Fendley ..... 210/522
7,552,827 B2 * 6/2009 Menke et al. ..... 209/156
2003/0234227 A1 12/2003 Niitti

OTHER PUBLICATIONS

Finnish Search Report dated Oct. 23, 2009 for Finland Application No. 20086227, citing U.S. Patent Publication No. 2003/0234227 on p. 4 thereof.

* cited by examiner

*Primary Examiner* — Joseph C Rodriguez
(74) *Attorney, Agent, or Firm* — Allen Dyer Doppelt Milbrath & Gilchrist

(57) ABSTRACT

A method for separating particles in hydrous slurry comprises connecting at least one teeter water pipe of a teeter water distributor of a hindered-bed separator in fluid connection with a teeter water discharging mechanism, and discharging teeter water from the at least one teeter water pipe to the teeter water discharging mechanism.

21 Claims, 6 Drawing Sheets

METHOD FOR SEPARATING PARTICLES IN HYDROUS SLURRY AND A HINDERED-BED SEPARATOR

FIELD OF THE INVENTION

The invention relates to a method for separating particles in hydrous slurry and a hindered-bed separator or hindered-bed settler or similar separator or settler apparatus (hereinafter "hindered-bed settler") to partition solid particles in a hydrous slurry or pulp into two or more fractions containing particles of different size and density.

BACKGROUND OF THE INVENTION

Many sizing and classifying methods employ gravity of solid material in hydrous slurry with an incoming feed containing the material encountering an upward teeter water flow. The variation in size and/or density will result in heavier particles failing to a lower level of the hindered-bed settler and lighter particles being uplifted to an overflow level of the hindered-bed settler thus affecting the desired separation.

The operation of so called hindered-bed settlers is based on even distribution of a controlled amount of teeter water into an in inner space of the body of the hindered-bed separator with teeter water distributor means arranged in the inner space of the body of the hindered-bed separator. Usually, the teeter water is pumped into teeter pipes of the teeter water distributor means from one side only, but if the water is "dirty" and contains for example fine solids much s, the teeter water pipes will get clogged because of the fine solids settling at the end of the teeter pipe where the flow velocity is lowest. Gradually this clogging then is proceeding towards the feed end of the teeter pipes and relatively soon the teeter water feed into the hindered-bed settler becomes biased and operation becomes poor. The hindered-bed settler has to be stopped for pipe cleaning meaning production losses etc. In some cases teeter water is pumped into the teeter pipes from both ends, but then the clogging starts from the middle of the teeter pipes.

SUMMARY OF THE INVENTION

The aim of the invention is to solve the above-identified problem.

According to an embodiment of the present invention, a hindered-bed separator for separating particles in hydrous slurry comprises a body defining an inner space, a teeter water distributor means comprising teeter water pipes arranged in the inner space of the body for introducing teeter water into the inner space of the body and directing water therefrom, a first manifold, an intake pipe for introducing teeter water into the first manifold, the teeter water pipes being in fluid connection with the first manifold, the teeter water pipes having apertures for discharging teeter water from the teeter water pipes into the inner space of the body, a feed well means for introducing hydrous slurry into the inner space of the body, an overflow launder means for discharging light particles from the inner space of the body, and a coarse feed means for discharging heavy particles from the inner space of the body. The at least one teeter water pipe is in fluid connection with a teeter water discharging means for discharging teeter water from said at least one teeter water pipe of the teeter water distributor means into the teeter water discharging means.

According to a method aspect of the present invention, a method for separating particles in hydrous slurry, comprises using a hindered-bed separator comprising a body defining an inner space, feed well means for introducing hydrous slurry into the inner space of the body, overflow launder means for discharging light particles from the inner space of the body, coarse feed means for discharging heavy particles from the inner space of the body, and teeter water distributor means comprising teeter water pipes arranged in the inner space of the body for introducing teeter water into the inner space of the body. Hydrous slurry is introduced into the inner space of the body. Teeter water is fed into the teeter water distributor means and teeter water is introduced into the inner space of the body by means of the teeter water distributor means. Light particles are discharged from the inner space of the body and heavy particles are discharged from the inner space of the body. At least one teeter water pipe of the teeter water distributor means is connected in fluid connection with a teeter water discharging means, and teeter water from the at least one teeter water pipe that is in fluid connection with the teeter water discharging means is discharged to the teeter water discharging means.

The invention is based on discharging part of the teeter water that is fed into the teeter water distributor means by using a teeter water discharging means that is in fluid connection with the teeter water distributor means. This means for example that a certain amount of teeter water is fed into the teeter water distributor means. This amount can for example be the double compared to the amount actually used for teetering in the hindered-bed separator, so the other half just runs through the teeter water pipes of the teeter water distributor means inside the hindered-bed separator. This way the flow speed in the teeter water pipes system is high or large enough to keep the teeter water pipes clean by transporting fine solids effectively through the teeter water pipes. This way an arrangement can be created that does not need cleaning of the teeter pipes at all or very seldom.

In a method and a hindered-bed separator somewhat dirty teeter water i.e. teeter water containing particles can be used. The new arrangement is essentially useful in cases where dirty circulating water e.g. from the tailings pond or thickener is used. Because of environmental reasons this is nowadays the most common situation in the industry.

In the suggested system the pipes could also be cleaned, if necessary, just by increasing momentarily the flow speed of water. The opening of the unit for cleaning would then not be necessary at all.

In one embodiment of the invention both in the intake pipe for feeding teetering water to the teeter water distributor means and in the return pipe for leading teetering water from the teeter water discharging means is provided with a flow measuring means, such as a flow meter, for measuring the flow before the hindered-bed separator and respectively for measuring the flow after the hindered-bed separator. The difference in the flows naturally flows into the interior of the hindered-bed separator. In this embodiment the amount of teeter water entering the inner space of the body of the hindered-bed separator and correspondingly the amount of teeter water flowing through the inner space of the body of the hindered-bed separator can be controlled by a valve means such as an automatic valve in the return pipe.

These and other objects, aspects and advantages of the invention will be better understood in view of the drawings and the following detailed description of preferred embodiments.

DETAILED DESCRIPTION OF PREFERRED EMBODIMENTS

Figure 1:
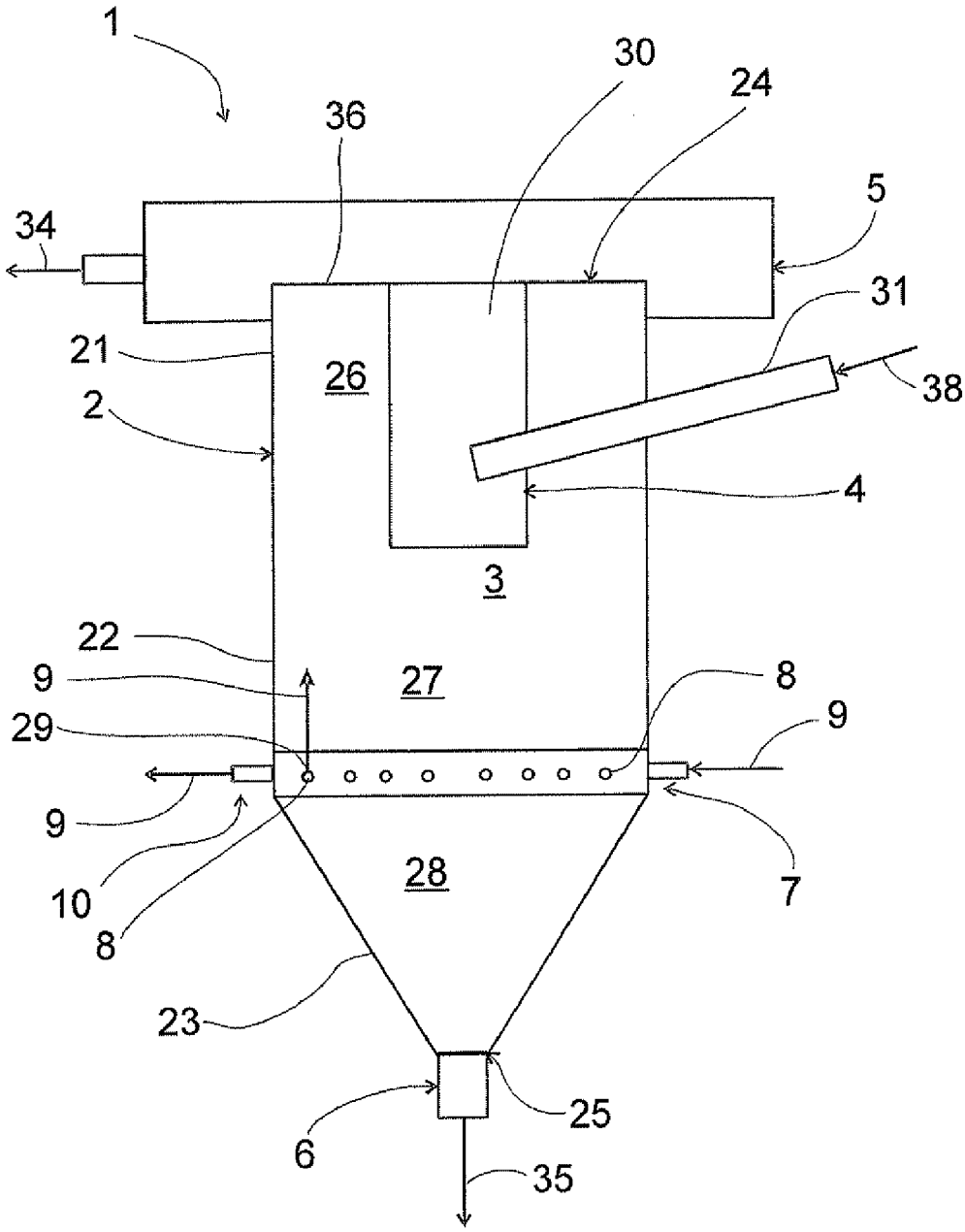
FIG. 1 shows a hindered-bed separator having a teeter water distributor means.

The invention relates to a method for separating particles (not shown in the Figures) in hydrous slurry 38 and to a hindered-bed separator 1 for separating particles in hydrous slurry 38.

First the method and preferred embodiments and variations thereof will be described.

The method for separating particles in hydrous slurry 38 comprises a step for using a hindered-bed separator comprising a body 2 defining an inner space 3, feed well means 4 for introducing hydrous slurry 38 into the inner space 3 of the body 2, overflow launder means 5 for discharging light particles 34 from the inner space 3 of the body 2, coarse feed means 6 for discharging heavy particles 35 from the inner space 3 of the body 2, and teeter water distributor means 7 comprising teeter water pipes 8 arranged in the inner space 3 of the body 2 for introducing teeter water 9 into the inner space 3 of the body 2.

The method includes a step for introducing hydrous slurry 38 into the inner space 3 of the body 2.

The method includes steps for feeding teeter water 9 into the teeter water distributor means 7 and introducing teeter water 9 into the inner space 3 of the body 2 by means of the teeter water distributor means 7. The amount of teeter water 9 fed into the teeter water distributor means 7 exceeds preferably, but not necessarily, the amount of teeter water 9 needed for the separation process performed in the inner space 3 of the body 2 of the hindered-bed separator. In one embodiment of the method of the invention, the method includes a step for feeding between about 110% to about 200% for example between about 125% to about 150%, the amount of teeter water 9 into the teeter water distributor means 7 of the amount of teeter water 9 that is needed for the separation process performed in the inner space 3 of the body 2 of the hindered-bed separator 1.

The method includes a step for discharging light particles 34 from the inner space 3 of the body 2.

The method includes a step for discharging heavy particles 35 from the inner space 3 of the body 2.

The method includes a step for connecting at least one teeter water pipe 8 of the teeter water distributor means 7 in fluid connection with a teeter water discharging means 10.

The method includes a step for discharging teeter water 9 from the at least one teeter water pipe 8 that is in fluid connection with the teeter water discharging means 10 to the teeter water discharging means 10.

The method includes preferably a step for connecting all teeter water pipes 8 of the teeter water distributor means 7 in fluid connection with a teeter water discharging means 10 and a step for discharging teeter water from all teeter water pipes 8 to the teeter water discharging means 10.

The method comprises in a preferable embodiment of the method using a hindered-bed separator 1 having a teeter water distributor means 7 having at least one teeter water pipe 8 that has a first end 11, which is in fluid connection with a first manifold 12 configured for receiving teeter water 9 from an intake pipe 32 and configured for distributing teeter water 9 to the at least one teeter water pipe 8 that is in fluid connection with the first manifold 12, and which has an opposite second end 13. This preferred embodiment of the method of the invention comprises a step for connecting the opposite second end 13 of the at least one teeter water pipe 8 that is in fluid connection with the first manifold 12, in fluid connection with the teeter water discharging means 10. This preferred embodiment of the method of the invention comprises preferably a step for connecting the opposite second end 13 of the at least one teeter water pipe 8 that is in fluid connection with the first manifold 12, in fluid connection with a second manifold 14 of the teeter water discharging means 10.

The method comprises in a preferable embodiment of the method using a hindered-bed separator 1 having a teeter water distributor means 7 having several teeter water pipes 8 each having a first end 11, which is in fluid connection with a first manifold 12 configured for receiving teeter water 9 from an intake pipe 32 and configured for distributing teeter water 9 to the several teeter water pipes 8 that are in fluid connection with the first manifold 12, and each of which teeter water pipes 8 has a opposite second end 13. This preferred embodiment of the method of the invention comprises a step for connecting the opposite second end 13 of each teeter water pipe 8, which are in fluid connection with the first manifold 12, in fluid connection with the teeter water discharging means 10. This preferred embodiment of the method of the invention comprises preferably a step for connecting the opposite second end 13 of each teeter water pipe 8, which are in fluid connection with the first manifold 12, in fluid connection with a second manifold 14 of the teeter water discharging means 10.

The method comprises in a preferable embodiment of the method a step for arranging a first valve means 15 to the teeter water discharging means 10 to adjust the amount of teeter water 9 that is discharged from the teeter water discharging means 10.

Figure 3:
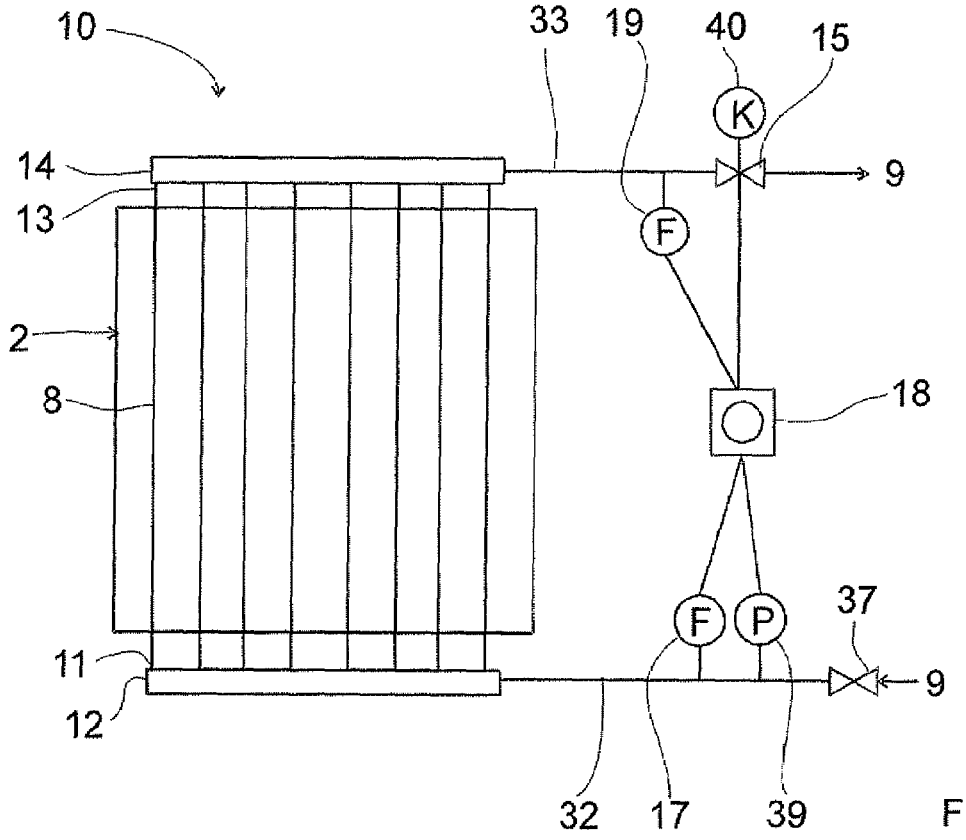
FIG. 3 shows the principle of a teeter water distribution system means according to a second preferred embodiment of the invention.
Figure 5:
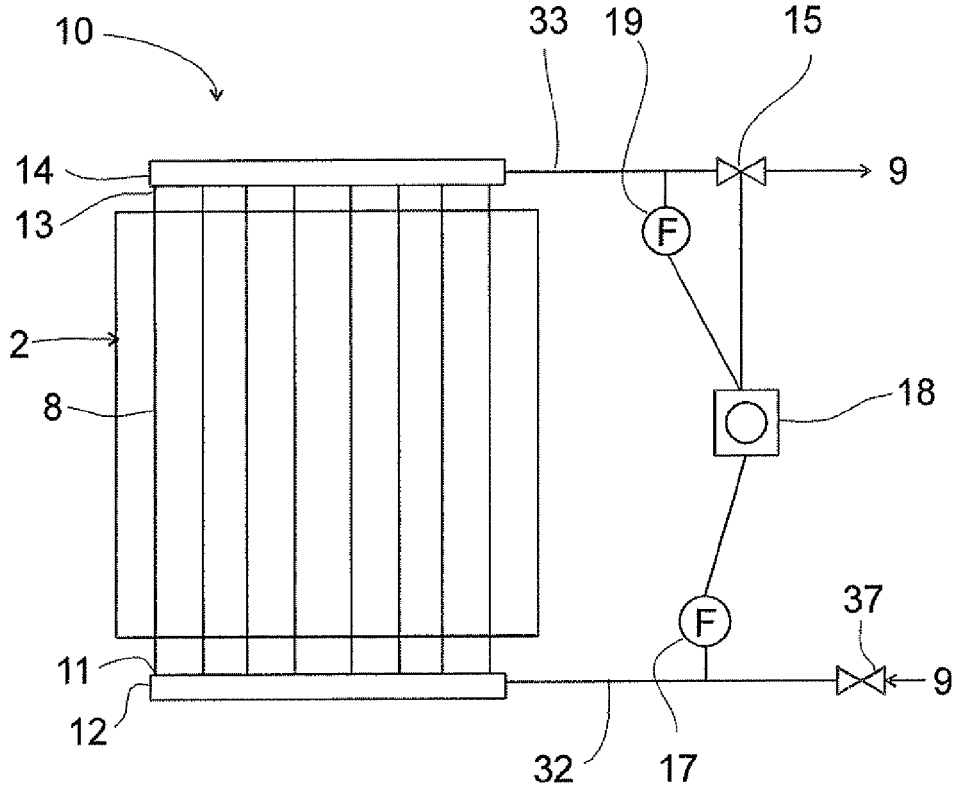
FIG. 5 shows the principle of a teeter water distribution system means according to a fourth preferred embodiment of the invention
Figure 6:
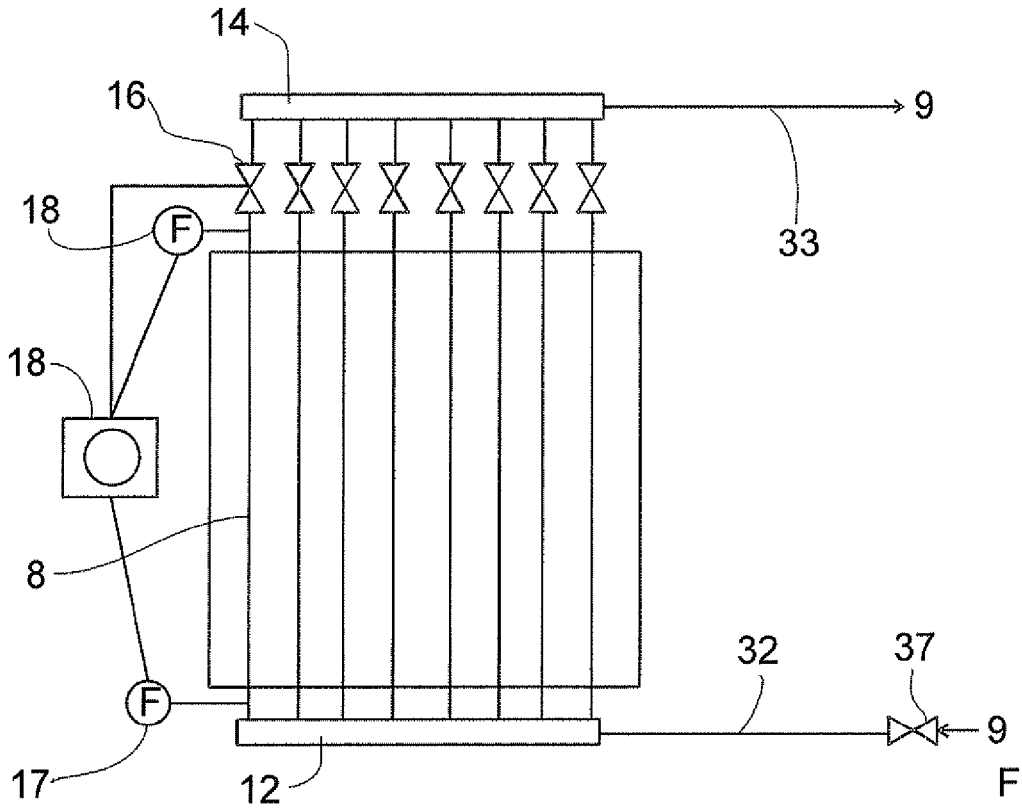
FIG. 6 shows the principle of a teeter water distribution system means according to a fifth preferred embodiment of the invention.
Figure 7:
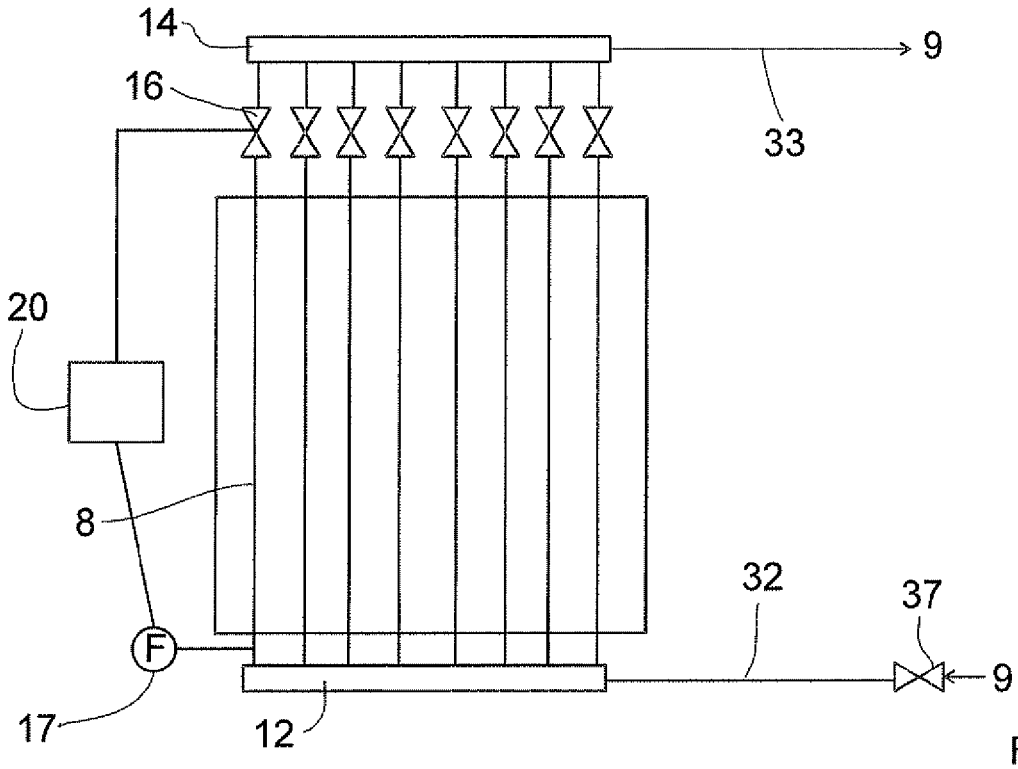
FIG. 7 shows the principle of a teeter water distribution system means according to a sixth preferred embodiment of the invention.

The method comprises in a preferable embodiment of the method a step for arranging a first valve means 15 to the teeter water discharging means 10 to adjust the amount of teeter water 9 that is discharged from the teeter water discharging means 10. This preferable embodiment of the method includes a step for measuring by means of a first flow measuring means 17 the amount of inflowing teeter water 9 flowing into the teeter water distributor means 7 and a step for measuring by means of a second flow measuring means 19 the amount of outflowing teeter water 9 flowing from the teeter water discharging means 10. This preferable embodiment of the method includes a step for calculating the difference between the inflowing teeter water 9 and the outflowing teeter water 9, and a step for controlling the first valve means 15 in accordance with the calculated difference to adjust the flow in the teeter water discharging means 10, in other words to adjust the flow of teeter water 9 flowing through the inner space 3 of the body 2 of the hindered-bed separator 1. FIGS. 3 and 5 illustrates arrangements suitable for this preferred embodiment. In this preferred embodiment the amount of teeter water entering the inner space 3 of the body 2 of the hindered-bed separator 1 can also be calculated by means of the calculated difference, i.e. the amount of teeter water 9 going into the separation process can also be calculated from the calculated difference.

Figure 4:
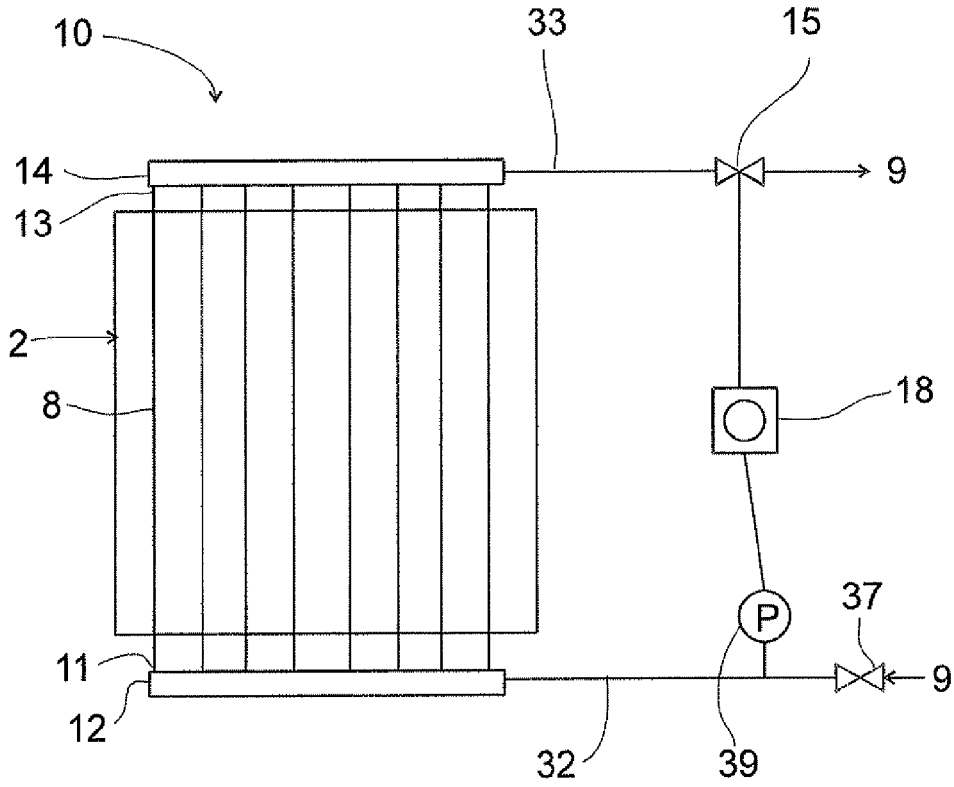
FIG. 4 shows the principle of a teeter water distribution system means according to a third preferred embodiment of the invention.

The method comprises in a preferable embodiment of the method a step for arranging a first valve means 15 to the teeter water discharging means 10 to adjust the amount of teeter water 9 discharged from the teeter water discharging means 10. This preferable embodiment of the method includes a step for measuring by means of a pressure measuring means 39 the pressure of inflowing teeter water 9 flowing into the teeter water distributor means 7. This preferable embodiment of the method includes a step for controlling the first valve means 15 in accordance with the measured pressure to adjust the flow in the teeter water discharging means 10, in other words to adjust the flow of teeter water flowing through the inner space 3 of the body 2 of the hindered-bed separator. FIGS. 3 and 4 illustrates arrangements suitable for this preferred embodiment.

Figure 8:
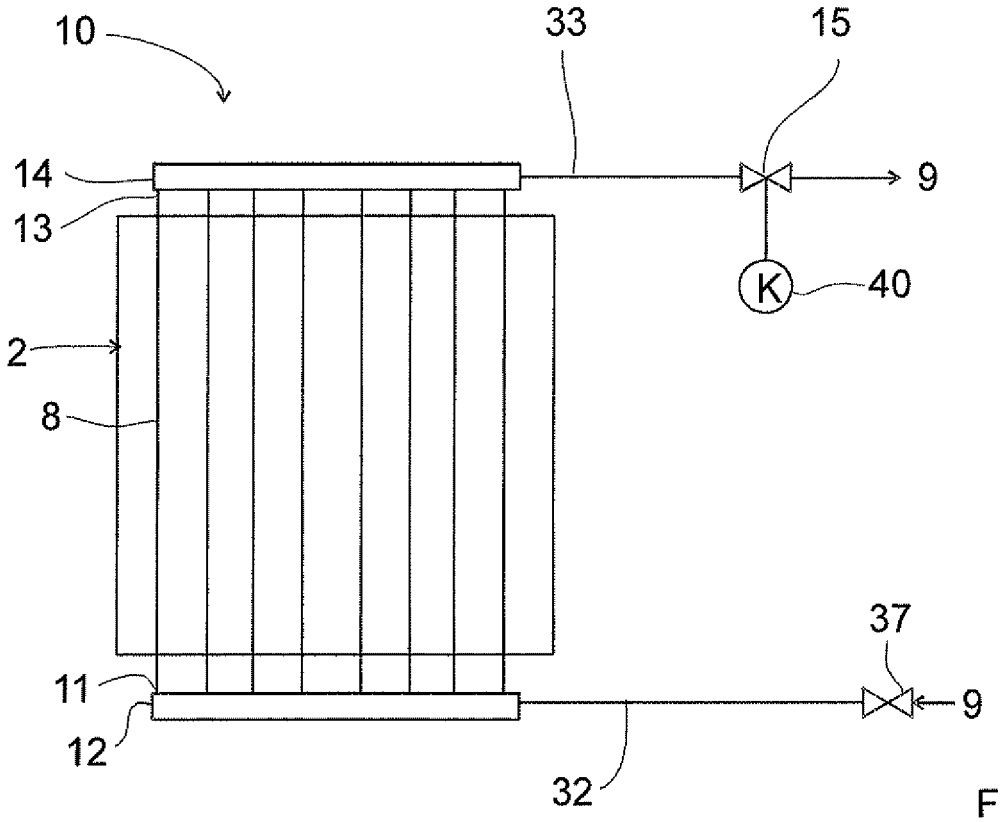
FIG. 8 shows the principle of a teeter water distribution system means according to a seventh preferred embodiment of the invention.

The method comprises in a preferable embodiment of the method a step for arranging a first valve means 15 in the teeter water discharging means 10 to adjust the amount of teeter water 9 discharged from the teeter water discharging means 10. This preferable embodiment of the method of the invention includes steps for controlling the first valve means 15 by means of a timer 40 for example according to a pre-set time schedule FIGS. 3 and 8 illustrates arrangements suitable for this preferred embodiment.

The method comprises in a preferable embodiment of the method a step for arranging a second valve means 16 in the at least one teeter water pipe 8 that is in fluid connection with the teeter water discharging means 10 and a step for controlling the second valve means 16 to adjust the amount of teeter water flowing from said at least one teeter water pipe 8 that is in fluid connection with the teeter water discharging means 10 into said teeter water discharging means 10.

The method comprises in a preferable embodiment of the method of the invention a step for arranging second valve means 16 in all the teeter water pipes 8 that are in fluid connection with the teeter water discharging means 10 and a step for individually controlling the second valve means 16 to individually adjust the amount of teeter water flowing from each teeter water pipe 8 into said teeter water discharging means 10.

The method comprises in a preferable embodiment of the method a step for arranging a second valve means 16 in the at least one teeter water pipe 8 that is in fluid connection with the teeter water discharging means 10. This preferable embodiment of the method of the invention includes a step for measuring by means of a first flow measuring means 17 the amount of inflowing teeter water 9 flowing into said at least one teeter water pipe 8 that is in fluid connection with the teeter water discharging means 10 and a step for measuring by means of a second flow measuring means 18 the amount of outflowing teeter water 9 flowing from said at least one teeter water pipe 8 that is in fluid connection with the teeter water discharging means 10. This preferable embodiment of the method of the invention includes a step for calculating the difference between the inflowing teeter water 9 and the outflowing teeter water 9 and a step for controlling the second valve means 16 in accordance with the calculated difference to adjust the flow in said at least one teeter water pipe 8 that is in fluid connection with the teeter water discharging means 10, in other words to adjust the flow of teeter water flowing through the inner space 3 of the body 2 of the hindered-bed separator 1 in said at least one teeter water pipe 8 that is in fluid connection with the teeter water discharging means 10.

Figure 10:
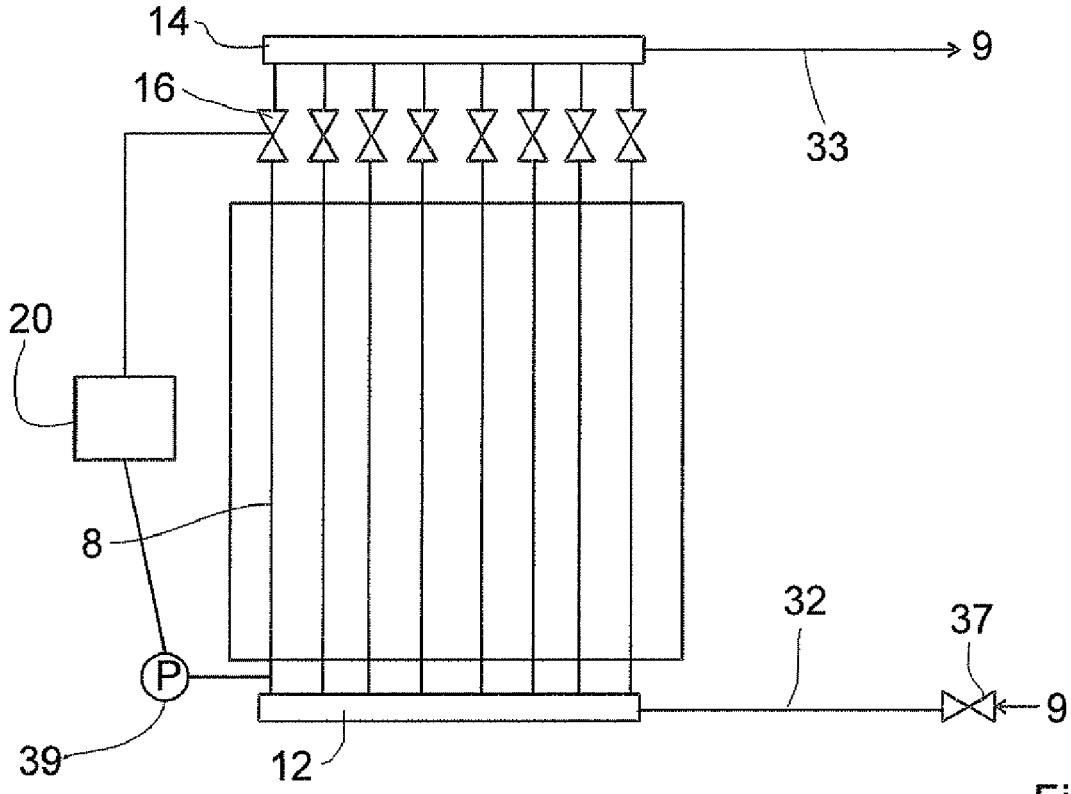
FIG. 10 shows the principle of a teeter water distribution system means according to a ninth preferred embodiment of the invention.

The method comprises in a preferable embodiment of the method a step for arranging a second valve means 16 in the at least one teeter water pipe 8 that is in fluid connection with the teeter water discharging means 10. This preferable embodiment of the method of the invention includes steps for measuring by means of a first pressure measuring means 39 the pressure of teeter water 9 flowing into said teeter water pipe 8 that is in fluid connection with the teeter water discharging means 10 and for controlling the second valve means 16 in accordance with the measured pressure to adjust the flow in said at least one teeter water pipe 8 that is in fluid connection with the teeter water discharging means 10, in other words to adjust the flow of teeter water flowing through the inner space 3 of the body 2 of the hindered-bed separator 1 in said at least one teeter water pipe 8 that is in fluid connection with the teeter water discharging means 10. FIG. 10 illustrate an arrangement suitable for this preferred embodiment.

Figure 9:
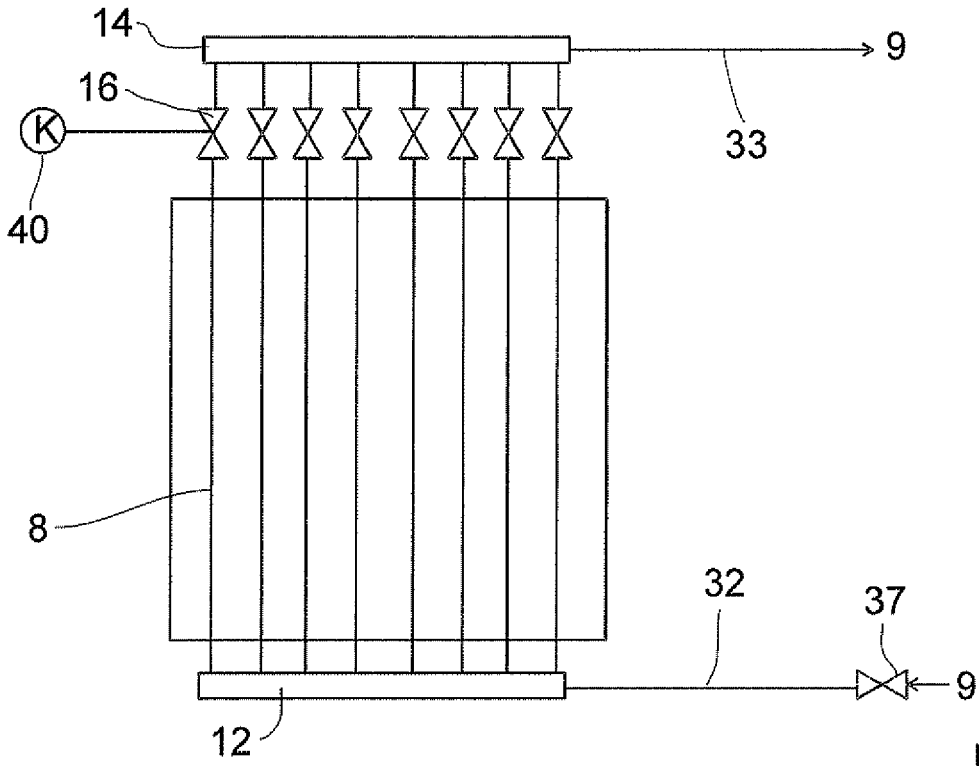
FIG. 9 shows the principle of a teeter water distribution system means according to an eighth preferred embodiment of the invention.

The method comprises in a preferable embodiment of the method a step for arranging a second valve means 16 in said at least one teeter water pipe 8 that is in fluid connection with the teeter water discharging means 10. This preferable embodiment of the method of the invention includes steps for controlling the second valve means 16 with a timer 40 for example in accordance with a pre-set schedule. FIG. 9 illustrates an arrangement suitable for this preferred embodiment.

The method comprises in a preferable embodiment of the method a step for arranging second valve means 16 in all the teeter water pipes 8 that are in fluid connection with the teeter water discharging means 10. This preferable embodiment of the method of the invention includes a step for individually measuring the amount of inflowing teeter water 9 flowing into each teeter water pipe 8 that are in fluid connection with the teeter water discharging means 10 and a step for individually measuring the amount of teeter water 9 flowing out from each teeter water pipe 8 that are in fluid connection with the teeter water discharging means 10 into the teeter water discharging means 10. This preferable embodiment of the method of the invention includes a step for calculating the difference between the inflowing teeter water and the outflowing teeter water in each individual teeter water pipe 8 that are in fluid connection with the teeter water discharging means 10 and a step for controlling each second valve means 16 in each teeter water pipe 8 that are in fluid connection with the teeter water discharging means 10 in accordance with the calculated difference to individually adjust the flow in each teeter water pipe 8 that are in fluid connection with the teeter water discharging means 10, in other words to individually adjust the flow of teeter water 9 flowing through the inner space 3 of the body 2 of the hindered-bed separator 1 in each individual teeter water pipe 8.

The method comprises in a preferable embodiment of the method a step for arranging second valve means 16 in all teeter water pipes 8 that are in fluid connection with the teeter water discharging means 10. This preferable embodiment of the method of the invention includes a step for measuring the pressure of teeter water 9 flowing into each teeter water pipe 8 that are in fluid connection with the teeter water discharging means 10 and for individually controlling each second valve means 16 in each teeter water pipe 8 in accordance with the measured pressure to individually adjust the flow in each teeter water pipe 8 that are in fluid connection with the teeter water discharging means 10, in other words to adjust the flow of teeter water 9 flowing through the inner space 3 of the body 2 of the hindered-bed separator 1 individually in each individual teeter water pipes 8.

The method comprises in a preferable embodiment of the method a step for arranging second valve means 16 in all the teeter water pipes 8 that are in fluid connection with the teeter water discharging means 10. This preferable embodiment of the method of the invention includes a step for individually controlling each second valve means 16 in each teeter water pipe 8 with a timer 40 for example according to a pre-set time schedule.

Next the hindered-bed separator 1 for separating particles in a hydrous slurry 38 and preferred embodiments and variations of the hindered-bed separator 1 will be described.

The hindered-bed separator 1 comprises a body 2 defining an inner space 3.

The body 2 of the hindered-bed separator 1 shown in FIG. 1 has an upper part 21, a middle part 22, and a lower part 23 and an open top 24 and a bottom 25 defining the inner space 3 with an upper portion 26, a middle portion 27, and a lower portion 28.

A teeter water distributor means 7 comprises teeter water pipes 8 is at least partly arranged in the inner space 3 of the body 2 for introducing teeter water into the inner space 3 of the body 2 and directing water therefrom.

The teeter water distributor means 7 comprises a first manifold 12, an intake pipe 32 for introducing teeter water into the first manifold 12 and teeter water pipes 8 in fluid connection with the first manifold 12. The teeter water pipes 8 are provided with apertures 29 for discharging teeter water from the teeter water pipes 8 into the inner space 3 of the body 2.

In the FIGS. 2 to 10 the intake pipe 32 is provided with a third valve means 37.

In FIG. 1 the teeter water distributor means 7 is arranged for introducing teeter water into the lower portion 28 of inner space 3 of the body 2.

The hindered-bed separator 1 comprises also a teeter water discharging means 10 that is in fluid connection with at least one teeter water pipe 8 for discharging teeter water 9 from the at least one teeter water pipe 8 that is in fluid connection with the teeter water discharging means 10 into the teeter water discharging means 10.

The hindered-bed separator 1 comprises also a feed well means 30 for introducing hydrous slurry 38 into the inner space 3 of the body 2.

In FIG. 1 the feed well means 30 for introducing hydrous slurry 38 into the inner space 3 of the body 2 comprises a feed well 30 for feed material entering the hindered-bed separator 1 and a slurry introducer 31 for introducing hydrous slurry 38 into the feed well 30.

The hindered-bed separator 1 comprises also an overflow launder means 5 for discharging light particles 34 from the inner space 3 of the body 2.

In FIG. 1 the overflow launder means 5 is arranged adjacent to the open top 24 of the body 2.

In FIG. 1 the overflow launder means 5 of the hindered-bed separator 1 comprises also an overflow weir 36 adjacent to the open top 24 of the body 2 for providing flow containing light particles 35 from the inner space 3 of the body 2 through the open top 24 of the body 2 to the overflow launder.

The hindered-bed separator 1 comprises also a coarse feed means 6 for discharging heavy particles from the inner space 3 of the body 2.

In FIG. 1 the coarse feed means 6 are arranged adjacent to the bottom 25 of the body 2.

In a preferred embodiment of the hindered-bed separator 1 according to the invention the teeter water discharging means 10 comprises a second manifold 14 in fluid connection with the at least one teeter water pipe 8 and a return pipe 33 for discharging teeter water from the second manifold 14. The second manifold 14 is configured for receiving teeter water from the at least one teeter water pipe 8 and for discharging teeter water into the return pipe 33. The at least one teeter water pipe 8 is preferably arranged between the first manifold 12 and the second manifold 14.

In a preferred embodiment of the hindered-bed separator 1 the teeter water discharging means 10 comprises a second manifold 14 in fluid connection with all teeter water pipes 8 of the teeter water distributor means 7 and a return pipe 33 for discharging teeter water from the second manifold 14. The second manifold 14 is configured for receiving teeter water from all teeter water pipes 8 of the teeter water distributor means 7 and for discharging teeter water into the return pipe 33. All teeter water pipes 8 of the teeter water distributor means 7 are preferably arranged between the first manifold 12 and the second manifold 14.

Figure 2:
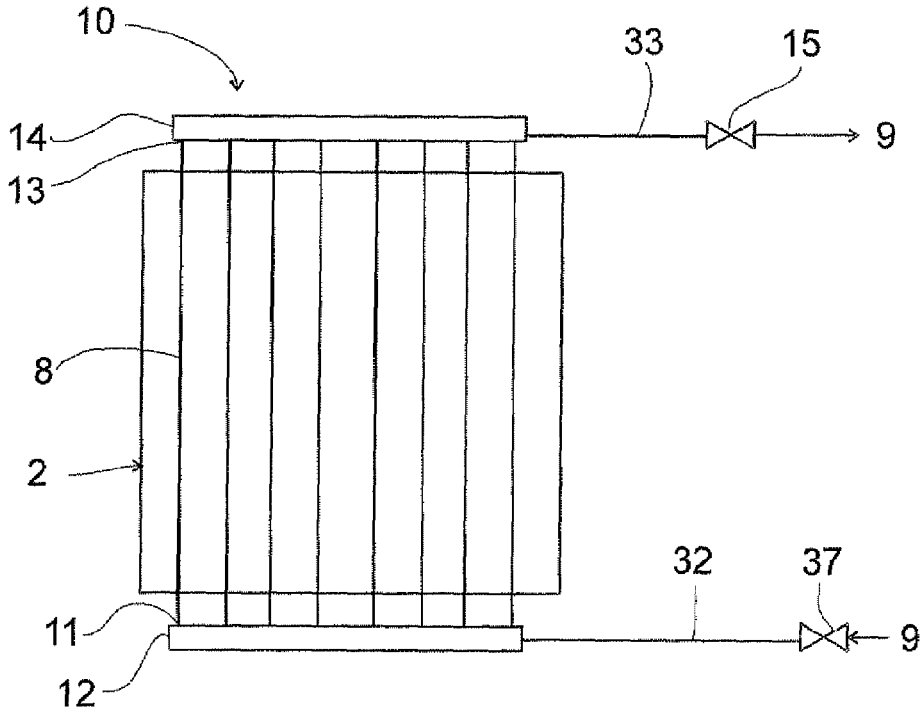
FIG. 2 shows the principle of a teeter water distribution system means according to a first preferred embodiment of the invention.

In a preferred embodiment of the hindered-bed separator 1, the hindered-bed separator 1 comprises and first valve means 15 in the teeter water discharging means 10 for adjusting the amount of teeter water 9 discharged from the teeter water discharging means 10 into a return pipe 33. The first valve means 15 can be arranged in the return pipe 33 as shown in FIG. 2.

In a preferred embodiment of the hindered-bed separator 1, the hindered-bed separator 1 comprises first flow measuring means 17 for measuring the amount of teeter water flowing from an intake pipe 32 into the teeter water distributor means 7, and second flow measuring means 19 for measuring the amount of teeter water flowing out of the inner space 3 of the body 2 via the teeter water discharging means 10 into a return pipe 33. This preferred embodiment of the hindered-bed separator 1 comprises calculating means 18 for calculating the difference between the inflowing teeter water and the outflowing teeter water, and first valve means 15 functionally connected to the calculating means 18 for adjusting the amount of outflowing teeter water in accordance with the calculated difference. In this preferred embodiment also the amount of teeter water entering the inner space 3 of the body 2 of the hindered-bed separator 1 can be calculated by means of the calculated difference, i.e. the amount of teeter water going into the separation process can also be calculated by means of the calculated difference.

In the preferred embodiment of the hindered-bed separator 1 shown in FIGS. 3 and 4, the hindered-bed separator 1 comprises pressure measuring means 19 for measuring the pressure of teeter water flowing into the teeter water distributor means 7. In his preferred embodiment a first valve means 15 is functionally connected to the pressure measuring means 19 for adjusting the amount of teeter water flowing into the return pipe 33 in accordance with the measured pressure.

In the preferred embodiment of the hindered-bed separator 1 shown in FIGS. 3 and 8, the hindered-bed separator 1 comprises a timer 40 functionally connected to first valve means 15 in the teeter water discharging means 10 for adjusting the amount of teeter water 9 flowing into a return pipe 33 for example in accordance with a pre-set time schedule.

In a preferred embodiment of the hindered-bed separator a second valve means 16 is arranged in at least one teeter water pipe 8 that is in fluid connection with the teeter water discharging means 10 for adjusting the amount of teeter water 9 flowing from said at least one teeter water pipe 8 into the teeter water discharging means 10.

In a preferred embodiment of the hindered-bed separator 1 the hindered-bed separator 1 comprises first flow measuring means 17 for measuring the amount of teeter water 9 flowing into the at least one teeter water pipe 8 and second flow measuring means 19 for measuring the amount of teeter water 9 flowing out of the at least one teeter water pipe 8. This preferred embodiment of the hindered-bed separator 1 comprises calculating means 18 for calculating the difference between the inflowing teeter water and the outflowing teeter water, and second valve means 16 functionally connected to the calculating means 18 for adjusting the amount of outflowing teeter water in accordance with the calculated difference.

The preferred embodiment of the hindered-bed separator 1 shown in FIG. 4 comprises first flow measuring means 17 for measuring the amount of inflowing teeter water flowing into each individual teeter water pipe 8 and second flow measuring means 19 for measuring the amount of outflowing teeter water flowing out of the body 2 via each individual teeter water pipe 8. This preferred embodiment of the hindered-bed separator 1 comprises calculating means 18 for calculating the difference between the inflowing teeter water and the outflowing teeter water in each teeter water pipe 8, and second valve means 16 functionally connected to the calculating means 18 for adjusting the amount of outflowing teeter water in accordance with the calculated difference in each teeter water pipe 8. For clarity reasons FIG. 4 is simplified so that only one teeter water pipe 8 is in FIG. 4 provided with a first flow measuring means 17, second flow measuring means 19, calculating means 18, and a second valve means 16.

In a preferred embodiment of the hindered-bed separator 1, the hindered-bed separator 1 comprises first flow measuring means 17 for measuring the amount of inflowing teeter water flowing into the at least teeter water pipe 8 that is in fluid connection with the teeter water discharging means 10. This preferred embodiment of the hindered-bed separator 1 according to the invention comprises calculating means 19 for controlling that the amount of inflowing teeter water flowing into the at least one teeter water pipe 8 exceeds a pre-set value and second valve means 16 functionally connected to the control means 20 for increasing the amount of inflowing teeter water flowing into the at least one teeter water pipe 8 if the measured amount is below the pre-set value.

The preferred embodiment of the hindered-bed separator 1 shown in FIG. 5 comprises first flow measuring means 17 for measuring the amount of inflowing teeter water flowing into each individual teeter water pipe 8. This preferred embodiment of the hindered-bed separator 1 according to the invention comprises control means 20 for controlling that the amount of inflowing teeter water flowing into each individual teeter water pipe 8 exceeds a pre-set value and second valve means 16 functionally connected to the control means 20 for increasing the amount of inflowing teeter water flowing into in each teeter water pipe 8 if the measured amount is below the pre-set value. For clarity reasons FIG. 5 is simplified so that only one teeter water pipe 8 is in FIG. 5 provided with a first flow measuring means 17, calculating means 18, and a second valve means 16.

In a preferred embodiment of the hindered-bed separator 1, the at least teeter water pipe 8 that is in fluid connection with the teeter water discharging means 10 comprises first pressure measuring means 39 for measuring the pressure teeter water flowing into the at least teeter water pipe 8 that is in fluid connection with the teeter water discharging means 10. In this preferred embodiment of the hindered-bed separator 1 the first pressure measuring means is functionally connected to a second valve means 16 for adjusting the amount of teeter water flowing out the at least one teeter water pipe 8 that is in fluid connection with the teeter water discharging means 10 into the teeter water discharging means 10 in accordance with the pressure measured by the first pressure measuring means 39.

In a preferred embodiment of the hindered-bed separator 1, all teeter water pipes 8 are in fluid connection with the teeter water discharging means 10 and all teeter water pipes 8 comprises first pressure measuring means 39 for measuring the pressure teeter water flowing into the least teeter water pipe 8. In this preferred embodiment of the hindered-bed separator 1 each first pressure measuring means is functionally connected to a second valve means 16 arranged in each teeter water pipe 8 for individually adjusting the amount of teeter water flowing out of each teeter water pipe 8 into the teeter water discharging means 10 in accordance with the pressure measured by the first pressure measuring means 39.

In a preferred embodiment of the hindered-bed separator 1, the at least teeter water pipe 8 that is in fluid connection with the teeter water discharging means 10 comprises second valve means 16 for adjusting the amount of teeter water flowing into the at least one teeter water pipe 8 into the teeter water discharging means 10 and a timer 40 that is functionally connected to the second valve means for adjusting the amount of teeter water 9 flowing into the teeter water discharging means 10 for example in accordance with a pre-set time schedule.

In a preferred embodiment of the hindered-bed separator 1, all the teeter water pipe 8 that are in fluid connection with the teeter water discharging means 10 comprises second valve means 16 for adjusting the amount of teeter water flowing into the teeter water pipe 8 into the teeter water discharging means 10 and a timer 40 that is functionally connected to the second valve means for adjusting the amount of teeter water 9 flowing into the teeter water discharging means 10 based on a time schedule.

It is apparent to a person skilled in the art that as technology advances, the basic idea of the invention can be implemented in various ways. The invention and its embodiments are therefore not restricted to the above examples, but they may vary within the scope of the claims.

What is claimed is:

1. A method for separating particles in hydrous slurry, comprising:

using a hindered-bed separator comprising a body defining an inner space, feed well means for introducing hydrous slurry into the inner space of the body, overflow launder means for discharging light particles from the inner space of the body, coarse feed means for discharging heavy particles from the inner space of the body, and teeter water distributor means comprising teeter water pipes arranged in the inner space of the body for introducing teeter water into the inner space of the body;

introducing hydrous slurry into the inner space of the body;

feeding teeter water into the teeter water distributor means and introducing teeter water into the inner space of the body by means of the teeter water distributor means;

discharging light particles from the inner space of the body;

discharging heavy particles from the inner space of the body;

connecting at least one teeter water pipe of the teeter water distributor means in fluid connection with a teeter water discharging means;

discharging teeter water from the at least one teeter water pipe that is in fluid connection with the teeter water discharging means to the teeter water discharging means;

arranging a first valve means in fluid connection with the teeter water discharging means;

discharging teeter water from the teeter water discharging means;

measuring the amount of teeter water flowing into the teeter water distributor means from an intake pipe;

measuring the amount of discharged teeter water discharged from the teeter water discharging means into an return pipe;

calculating the difference between the amount of teeter water flowing into the teeter water distributor means and the amount of teeter water discharged from the teeter water discharging means; and controlling the first valve means in accordance with the calculated difference to adjust the amount of teeter water discharged from the teeter water discharging means.

2. The method according to claim 1, further comprising:

using a hindered-bed separator wherein said teeter water distributor means has at least one teeter water pipe, which has a first end that is in fluid connection with a first manifold configured for receiving teeter water from an intake pipe and configured for distributing teeter water to the at least one teeter water pipe, and which has an opposite second end; and connecting the opposite second end of the at least one teeter water pipe in fluid connection with the teeter water discharging means.

3. The method according to claim 2, further comprising:

connecting the opposite second end of the at least one teeter water pipe in fluid connection with a second manifold of the teeter water discharging means.

4. The method according to claim 1, further comprising:

feeding an amount of teeter water into the teeter water distributor means that exceeds the amount of teeter water needed for the separation process performed in the inner space of the body of the hindered-bed separator.

5. The method according to claim 1, further comprising:

feeding between about 110% to about 200% the amount of teeter water into the teeter water distributor means of the amount of teeter water that is needed for the separation process performed in the inner space of the body of the hindered-bed separator.

6. A method for separating particles in hydrous slurry, comprising:

using a hindered-bed separator comprising a body defining an inner space, feed well means for introducing hydrous slurry into the inner space of the body, overflow launder means for discharging light particles from the inner space of the body, coarse feed means for discharging heavy particles from the inner space of the body, and teeter water distributor means comprising teeter water pipes arranged in the inner space of the body for introducing teeter water into the inner space of the body;

introducing hydrous slurry into the inner space of the body;

feeding teeter water into the teeter water distributor means and introducing teeter water into the inner space of the body by means of the teeter water distributor means;

discharging light particles from the inner space of the body;

discharging heavy particles from the inner space of the body;

connecting at least one teeter water pipe of the teeter water distributor means in fluid connection with a teeter water discharging means;

discharging teeter water from the at least one teeter water pipe that is in fluid connection with the teeter water discharging means to the teeter water discharging means;

arranging a first valve means in fluid connection with the teeter water discharging means;

discharging teeter water from the teeter water discharging means;

measuring the pressure of the teeter water flowing into the teeter water distributor means; and controlling the first valve means in accordance with the measured pressure to adjust the amount of teeter water discharged from the teeter water discharging means.

7. A method for separating particles in hydrous slurry, comprising:

using a hindered-bed separator comprising a body defining an inner space, feed well means for introducing hydrous slurry into the inner space of the body, overflow launder means for discharging light particles from the inner space of the body, coarse feed means for discharging heavy particles from the inner space of the body, and teeter water distributor means comprising teeter water pipes arranged in the inner space of the body for introducing teeter water into the inner space of the body;

introducing hydrous slurry into the inner space of the body;

feeding teeter water into the teeter water distributor means and introducing teeter water into the inner space of the body by means of the teeter water distributor means;

discharging light particles from the inner space of the body;

discharging heavy particles from the inner space of the body;

connecting at least one teeter water pipe of the teeter water distributor means in fluid connection with a teeter water discharging means;

discharging teeter water from the at least one teeter water pipe that is in fluid connection with the teeter water discharging means to the teeter water discharging means;

arranging a first valve means in fluid connection with the teeter water discharging means;

discharging teeter water from the teeter water discharging means; and controlling the first valve means with a timer to adjust the amount of teeter water discharged from the teeter water discharging means.

8. A method for separating particles in hydrous slurry, comprising:

using a hindered-bed separator comprising a body defining an inner space, feed well means for introducing hydrous slurry into the inner space of the body, overflow launder means for discharging light particles from the inner space of the body, coarse feed means for discharging heavy particles from the inner space of the body, and teeter water distributor means comprising teeter water pipes arranged in the inner space of the body for introducing teeter water into the inner space of the body;

introducing hydrous slurry into the inner space of the body;

feeding teeter water into the teeter water distributor means and introducing teeter water into the inner space of the body by means of the teeter water distributor means;

discharging light particles from the inner space of the body;

discharging heavy particles from the inner space of the body;

connecting at least one teeter water pipe of the teeter water distributor means in fluid connection with a teeter water discharging means;

discharging teeter water from the at least one teeter water pipe that is in fluid connection with the teeter water discharging means to the teeter water discharging means;

arranging a teeter water pipe valve means in at least one teeter water pipe that is in fluid connection with the teeter water discharging means, and controlling the teeter water pipe valve means to adjust the amount of teeter water that is discharged from said at least one teeter water pipe that is in fluid connection with the teeter water discharging means to the teeter water discharging means.

9. The method according to claim 8, further comprising:

measuring the amount of teeter water flowing into the at least one teeter water pipe that is in fluid connection with the teeter water discharging means;

measuring the amount of teeter water discharged from the at least teeter water pipe that is in fluid connection with the teeter water discharging means to the teeter water discharging means;

calculating the difference between the teeter water flowing into the at least one teeter water pipe that is in fluid connection with the teeter water discharging means and the teeter water that is discharged from the at least teeter water pipe that is in fluid connection with the teeter water discharging means; and controlling the teeter water pipe valve means in accordance with the calculated difference to adjust the amount of teeter water discharged from the at least teeter water pipe that is in fluid connection with the teeter water discharging means to the teeter water discharging means.

10. The method according to claim 8, further comprising:

measuring the pressure of teeter water flowing into the at least one teeter water pipe that is in fluid connection with the teeter water discharging means; and controlling the teeter water pipe valve means in accordance with the measured pressure to adjust the amount of teeter water discharged from the at least teeter water pipe that is in fluid connection with the teeter water discharging means to the teeter water discharging means.

11. The method according to claim 8, further comprising:

controlling the teeter water pipe valve means with a timer to adjust the amount of teeter water discharged from the at least teeter water pipe that is in fluid connection with the teeter water discharging means to the teeter water discharging means.

12. A hindered-bed separator for separating particles in hydrous slurry, the hindered-bed separator comprising:

a body defining an inner space;

a teeter water distributor means comprising teeter water pipes arranged in the inner space of the body for introducing teeter water into the inner space of the body and directing water therefrom, a first manifold, an intake pipe for introducing teeter water into the first manifold, the teeter water pipes being in fluid connection with the first manifold, the teeter water pipes having apertures for discharging teeter water from the teeter water pipes into the inner space of the body;

a feed well means for introducing hydrous slurry into the inner space of the body;

an overflow launder means for discharging light particles from the inner space of the body;

a teeter water discharging means;

at least one teeter water pipe in fluid connection with the teeter water discharging means for discharging teeter water from said at least one teeter water pipe of the teeter water distributor means into the teeter water discharging means;

a coarse feed means for discharging heavy particles from the inner space of the body;

a first valve means arranged in fluid connection with the teeter water discharging means for adjusting the amount of teeter water discharged from the teeter water discharging means into a return pipe;

first flow measuring means for measuring the amount of teeter water flowing into the teeter water distributor means from the intake pipe;

second flow measuring means for measuring the amount of teeter water discharged from the teeter water discharging means into the return pipe; and calculating means for calculating the difference between the teeter water flowing into teeter water distributor means and the amount of teeter water discharged from the teeter water discharging means;

wherein the calculating means is functionally connected to the first valve means for adjusting the amount of teeter water discharged from the teeter water discharging means in accordance with the calculated difference.

13. The hindered-bed separator according to claim 12, wherein the teeter water discharging means comprises a second manifold in fluid connection with the at least one teeter water pipe that is in fluid connection with the teeter water discharging means and a return pipe for discharging teeter water from the second manifold, the second manifold being configured for receiving teeter water from the at least one teeter water pipe that is in fluid connection with a teeter water discharging means and configured for discharging teeter water into the return pipe.

14. The hindered-bed separator according to claim 13, wherein the at least one teeter water pipe is arranged between the first manifold and the second manifold.

15. The hindered-bed separator according to claim 12, wherein:

the body has an upper part, a middle part, and a lower part and an open top and a bottom defining the inner space with an upper portion, middle portion, and lower portion;

the overflow launder means is arranged adjacent to the open top of the body;

the hindered-bed separator further comprises an overflow weir adjacent to the open top of the body providing flow from the inner space of the body through the open top of the body to the overflow launder means;

the coarse discharging means is arranged adjacent to the bottom of the body; and the teeter water distributor means is arranged for introducing teeter water into the lower portion of inner space of the body.

16. The hindered-bed separator according to claim 12, wherein the feed well means for introducing hydrous slurry into the inner space of the body comprises a feed well for feed material entering the hindered-bed separator and a slurry introducer for introducing a hydrous slurry into the feed well.

17. A hindered-bed separator for separating particles in hydrous slurry, the hindered-bed separator comprising:

a body defining an inner space;

a teeter water distributor means comprising teeter water pipes arranged in the inner space of the body for introducing teeter water into the inner space of the body and directing water therefrom, a first manifold, an intake pipe for introducing teeter water into the first manifold, the teeter water pipes being in fluid connection with the first manifold, the teeter water pipes having apertures for discharging teeter water from the teeter water pipes into the inner space of the body;

a feed well means for introducing hydrous slurry into the inner space of the body;

an overflow launder means for discharging light particles from the inner space of the body;

a teeter water discharging means;

at least one teeter water pipe in fluid connection with the teeter water discharging means for discharging teeter water from said at least one teeter water pipe of the teeter water distributor means into the teeter water discharging means;

a coarse feed means for discharging heavy particles from the inner space of the body;

a first valve means arranged in fluid connection with the teeter water discharging means for adjusting the amount of teeter water discharged from the teeter water discharging means into a return pipe; and pressure measuring means for measuring the pressure of teeter water flowing into teeter water distributor means;

wherein the pressure measuring means is functionally connected to the first valve means for adjusting the amount of teeter water discharged from the teeter water discharging means into the return pipe in accordance with the measured pressure.

18. A hindered-bed separator for separating particles in hydrous slurry, the hindered-bed separator comprising:

a body defining an inner space;

a teeter water distributor means comprising teeter water pipes arranged in the inner space of the body for introducing teeter water into the inner space of the body and directing water therefrom, a first manifold, an intake pipe for introducing teeter water into the first manifold, the teeter water pipes being in fluid connection with the first manifold, the teeter water pipes having apertures for discharging teeter water from the teeter water pipes into the inner space of the body;

a feed well means for introducing hydrous slurry into the inner space of the body;

an overflow launder means for discharging light particles from the inner space of the body;

a teeter water discharging means;

at least one teeter water pipe in fluid connection with the teeter water discharging means for discharging teeter water from said at least one teeter water pipe of the teeter water distributor means into the teeter water discharging means;

a coarse feed means for discharging heavy particles from the inner space of the body; and a teeter water pipe valve means arranged in at least one teeter water pipe that is in fluid connection with the teeter water discharging means for adjusting the amount of teeter water discharged from said at least one teeter water pipe that is in fluid connection with the teeter water discharging means into the teeter water discharging means.

19. The hindered-bed separator according to claim 18, further comprising:

first flow measuring means for measuring the amount of teeter water flowing into the at least one teeter water pipe that is in fluid connection with the teeter water discharging means;

second flow measuring means for measuring the amount of teeter water flowing out of the at least one teeter water pipe that is in fluid connection with the teeter water discharging means into the teeter water discharging means; and calculating means for calculating the difference between the amount of teeter water flowing into the at least one teeter water pipe that is in fluid connection with the teeter water discharging means and the amount of teeter water flowing out of the at least one teeter water pipe that is in fluid connection with the teeter water discharging means into the teeter water discharging means;

wherein the teeter water pipe valve means is functionally connected to the calculating means for adjusting the amount of teeter water flowing out of the at least one teeter water pipe that is in fluid connection with the teeter water discharging means into the teeter water discharging means in accordance with the calculated difference.

20. The hindered-bed separator according to claim 18, further comprising:

pressure measuring means for measuring the pressure of teeter water flowing into the at least one teeter water pipe that is in fluid connection with the teeter water discharging means;

wherein the teeter water pipe valve means is functionally connected to the pressure measuring means for adjusting the amount of teeter water flowing out of the at least one teeter water pipe that is in fluid connection with the teeter water discharging means into the teeter water discharging means in accordance with the measured pressure.

21. The hindered-bed separator according to claim 18, wherein the teeter water pipe valve means is functionally connected to a timer for adjusting amount of teeter water flowing out of the at least one teeter water pipe that is in fluid connection with the teeter water discharging means into the teeter water discharging means in accordance with a time schedule.

* * * * *